US006619740B2

(12) United States Patent
Beggs

(10) Patent No.: US 6,619,740 B2
(45) Date of Patent: Sep. 16, 2003

(54) CHAIR CONTROL MECHANISM

(75) Inventor: Kenneth Arthur Beggs, Waterloo (CA)

(73) Assignee: Leggett & Platt, Ltd., Waterloo (CA)

( * ) Notice: Subject to any disclaimer, the term of this patent is extended or adjusted under 35 U.S.C. 154(b) by 0 days.

(21) Appl. No.: 09/845,576

(22) Filed: Apr. 30, 2001

(65) Prior Publication Data

US 2002/0163242 A1 Nov. 7, 2002

(51) Int. Cl.[7] ..... A47C 1/024

(52) U.S. Cl. ..... 297/300.1; 297/463.1; 297/302.7

(58) Field of Search ..... 297/302.1, 302.4, 297/302.5, 302.6, 302.7, 310, 463.1, 463.2, 300.1, 363, 364; 403/315, 316

(56) References Cited

U.S. PATENT DOCUMENTS 3,709,535 A * 1/1973 Rothermel
4,555,085 A * 11/1985 Bauer et al.
4,909,472 A * 3/1990 Piretti
6,012,776 A * 1/2000 Schneider et al.
6,352,308 B1 * 3/2002 Chen

FOREIGN PATENT DOCUMENTS

GB 676677 * 7/1952 ..... 403/316

* cited by examiner

*Primary Examiner*—Laurie K. Cranmer
(74) *Attorney, Agent, or Firm*—Shook, Hardy & Bacon L.L.P.

(57) ABSTRACT

A chair control mechanism is adapted to decrease a likelihood of the mechanism becoming unintentionally disengaged from a locked position. In particular, a control arm has locked position wherein a seat plate is restricted in movement relative to a main bracket and an unlocked position where the movement relative to said main bracket is allowed. A latch bar is biased against the control arm and the control arm is notched such that axial sliding of the control arm into said unlocked position is possible only after providing a force necessary to disengage said latch bar from said notch.

7 Claims, 3 Drawing Sheets

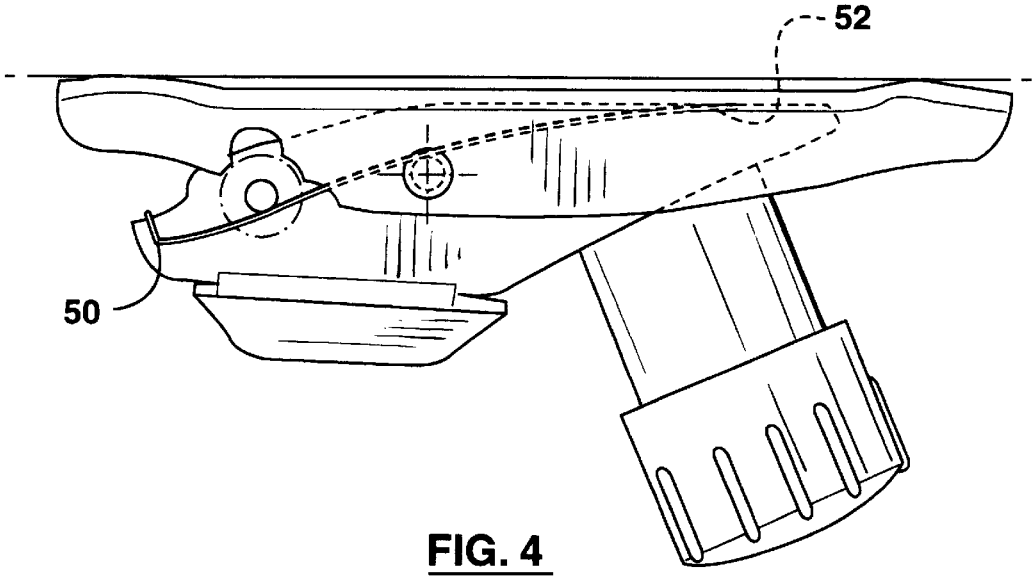
FIG. 4
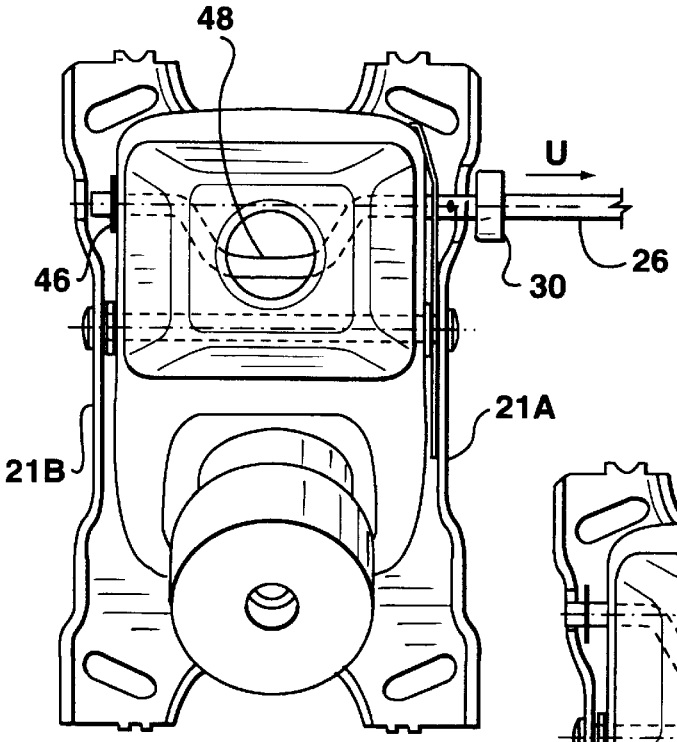
FIG. 5
FIG. 6
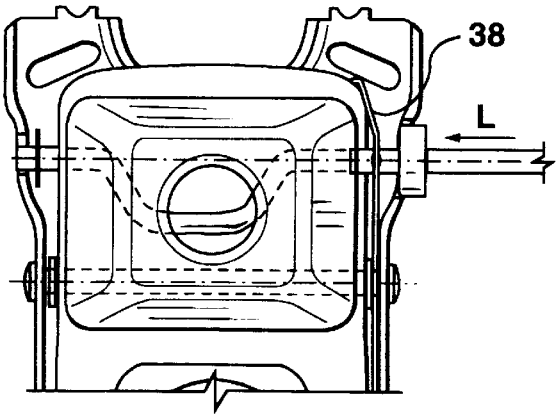

CHAIR CONTROL MECHANISM

FIELD OF THE INVENTION

The present invention relates to a chair control mechanism with a latch and a method of retrofitting a chair control mechanism with a latching apparatus.

BACKGROUND OF THE INVENTION

Chairs may have adjustable parts such as adjustable arm rests, seat and backrest. The angle the seat makes with respect to the floor, for instance, may be adjustable. In some such chairs, a person who wishes to lean back in the chair while maintaining the angle between the seat and backrest may move a control arm axially from a locked position to an unlocked position, to release the seat and backrest to tilt from an upright position. The seated person may subsequently return the seat and backrest to the upright position. In such an instance, to reclaim stability and avoid an unintentional lean, the seated person may move the control arm from the unlocked position to the locked position.

Unfortunately, the control arm may tend to creep axially during normal use of the chair such that the control may have a tendency to disengage from its locked position. This unintentional disengagement frees the seat to tilt, presenting a nuisance, or possibly even a dangerous situation to the user.

SUMMARY OF THE INVENTION

A latch for a chair control mechanism is adapted to decrease a likelihood of the mechanism becoming unintentionally disengaged from a locked position.

In accordance with an aspect of the present invention there is provided a chair control mechanism with a latch including an arm mounted in a main bracket for axial sliding between a first position and a second position and a latch bar extending transversely of the arm and biased against the arm to increase the force necessary to axially slide the arm.

In accordance with another aspect of the present invention there is provided a method of retrofitting a chair control mechanism with a latching apparatus, where the chair control mechanism includes an arm mounted in a main bracket for axial sliding between a first position and a second position, the method includes biasing a latch bar against the arm, to increase the force necessary to axially slide the arm, where the latch bar extends transversely of the arm.

In accordance with another aspect of the present invention there is provided a chair control mechanism with a latch. The chair control mechanism includes an arm mounted in a main bracket for axial sliding between a first position and a second position and a latch bar biased against the arm to increase the force necessary to axially slide the arm. The arm has a restraint adapted to engage the latch bar while the arm is in the first position, such that the axial sliding of the arm into the second position is possible only after providing a force necessary to disengage the latch bar from the restraint.

Other aspects and features of the present invention will become apparent to those of ordinary skill in the art upon review of the following description of specific embodiments of the invention in conjunction with the accompanying figures.

BRIEF DESCRIPTION OF THE DRAWINGS

In the figures which illustrate example embodiments of this invention:

FIG. 4 is a schematic side view of the chair control mechanism of FIG. 2;

FIG. 5 is a schematic bottom view of the chair control mechanism of FIG. 2 where the control arm is in the unlocked position; and FIG. 6 is a schematic partial bottom view of the chair control mechanism of FIG. 2 where the control arm is in the locked position.

DETAILED DESCRIPTION

Figure 1:
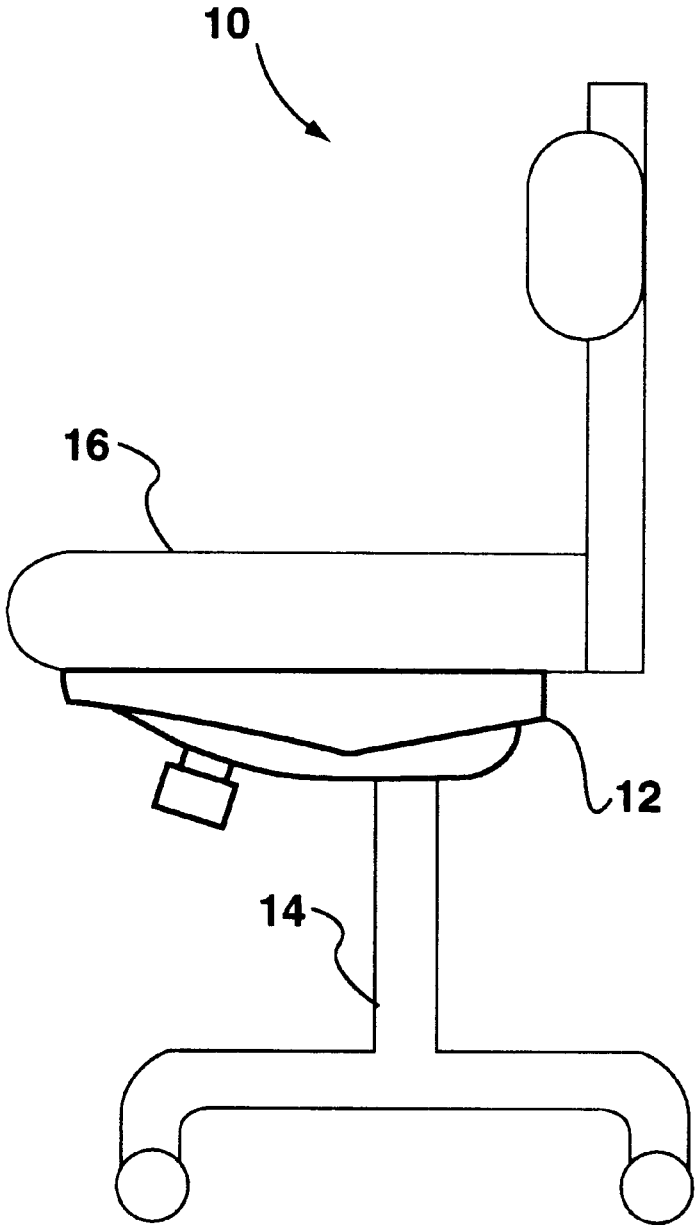
FIG. 1 is a schematic side view of a chair embodying the subject invention.

Referencing FIG. 1, a chair 10 has a chair control mechanism 12 that is mounted on a spindle base 14 and attached to a seat 16.

Figures 2, 3:
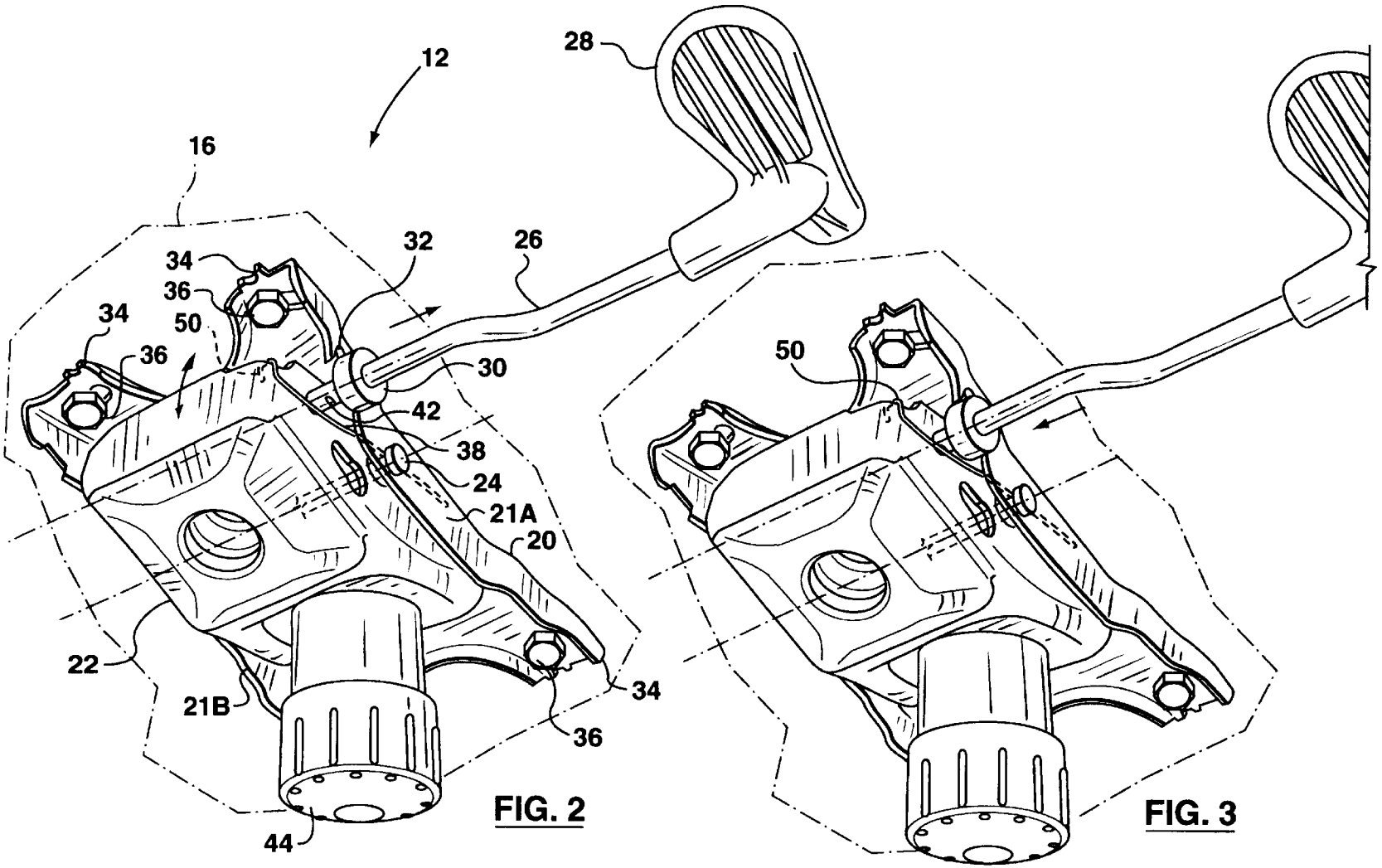
FIG. 2 is a schematic underside perspective view of a chair control mechanism having a control arm with a spring latch according to an embodiment of the present invention, where the control arm is in an unlocked position.
FIG. 3 is a schematic underside perspective view of the chair control mechanism of FIG. 2 where the control arm is in a locked position.

Turning to FIG. 2, the chair control mechanism 12 comprises a main bracket 22 and a seat plate 20. The main bracket 22 is pivotally attached to the seat plate 20 by a pivot pin 24. The main bracket 22 is mounted to the spindle base 14 of the chair 10. The seat plate 20 has seat mounting flanges 34 for accommodating bolts 36 to mount the seat 16 to the seat plate 20. The seat plate 20 also has side walls 21A, 21B that support the pivot pin 24.

In a conventional fashion, a tensioned main spring (not shown) within a housing 44 is mounted between the main bracket 22 and the seat plate 20. The tensioned main spring biases the seat plate 20 to a default (upright) position relative to the main bracket 22.

The main bracket 22 is furnished with corresponding apertures for slidably receiving a control arm 26 therethrough. The control arm 26 when installed in the main bracket 22 is capable of limited axial and rotational movement. The control arm 26 has a jog 48 (FIG. 5) which is positioned over an actuator (not shown) of the gas cylinder (not shown) in the spindle 14 (FIG. 1). A paddle 28 is mounted at a free end of the control arm 26. An enlarged bushing 30 is installed on the control arm 26 proximal to the seat plate side wall 21A. To accommodate the enlarged bushing 30, the seat plate side wall 21A has a wall notch 32. FIG. 3 illustrates the chair control mechanism of FIG. 2 where the control arm 26 is in a locked position.

Referencing FIG. 4 along with FIG. 2, a spring latch 38 is provided between the main bracket 22 and the side wall 21A. At one end, the spring latch 38 has a hook 50 that hooks onto and bears against the main bracket 22. From the hook end 50, the spring latch 38 snakes under the control arm 26 and over the pivot pin 24 to end 52 which bears against the bottom of the seat plate 20. The spring latch 38 has a configuration such that, when in place, it also bears against the control arm 26. A spring restraint in the nature of a notch 42 is provided in the control arm 26. The notch 42 receives the spring latch 38 when the control arm 26 is in its locked position. In other words, the locked position corresponds to a position wherein the enlarged bushing 30 prevents the seat plate 20 from moving relative to the main bracket 22.

FIGS. 5 and 6 illustrate the control arm 26 in an unlocked and locked position, respectively. Turning to FIG. 5, the control arm 26 may be moved in an unlocking direction, U, until a snap ring 46, provided on one end of the control arm 26, contacts the side of the main bracket 22. The control arm 26 is in an unlocked position whenever the enlarged bushing 30 ceases to block the seat plate side wall 21A. Referencing FIG. 6, the control arm 26 may be moved in a locking direction, L, until snap ring 46 contacts the side wall 21B of the seat plate 20. As aforementioned, in the locking position, the spring latch 38, is engaged by the notch 42 in the control arm 26 (FIG. 2). As will be apparent to a person skilled in the art, retainers other than the snap ring 46 may be used for the purpose of limiting the axial sliding of the control arm 26, such as a cotter pin, a hitch pin, a Woodruff key or a lynch pin.

In operation, a user may rotate the control arm 26 to depress the gas cylinder actuator in order to change the height of the chair. When the user of the chair 10 slides the control arm 26 from the unlocked position to the locked position, the spring latch 38 pops into engagement with the arm notch 42, thus latching the control arm 26 in place in a releasable manner. The spring constant of the spring latch 38 and the depth of the notch 42 are chosen so that the force required from the user of the chair 10 to disengage the spring latch 38 from the arm notch 42 is minimal, yet sufficient to avoid creep of the control arm 26.

Preferably, the arm notch 42 extends through a sufficient arc such that rotational motion of the control arm 26, while in the locked position, does not disengage the spring latch 38 from the arm notch 42.

Although the spring latch 38, as illustrated, is a resilient metal wire, it should be apparent that many alternative "latch bars" exist that may fit the criteria that the spring latch meets. Namely, that a given latch bar bears (is biased) against the control arm 26 and releasably engages with the arm notch 42. For example, the latch bar may comprise two rigid metal rods joined by a medial section of spring steel that biases the rods toward a given orientation.

As will be apparent to a person skilled in the art, the arm notch 42 need not be formed through the removal of material from the control arm 26. Instead, a pair of raised bumps on the control arm 26 would also serve as a notch to releasably engage the spring latch 38, or other latch bar. Indeed, a single bump, or a shoulder, in the control arm 26 may also serve as a suitable spring restraint. Furthermore, if the spring latch 38 has a sufficiently large spring constant, it may abut the control arm 26 with enough force to avoid control arm creep even absent any spring restraint on the control arm 26.

It will be apparent that the latch bar arrangement has application to a control arm with limited axial freedom but no rotational freedom.

Advantageously, the latch bar arrangement may be retrofit to existing chair control mechanisms. Where the existing chair control mechanism has an axially sliding control arm, such as control arm 26 (FIG. 2) a latch bar may be inserted to the position shown in FIG. 2 to increase the force necessary to axially slide the arm. Additionally, optionally, a hack saw or other cutting tool may be used to provide the control arm with a notch 42.

Other modifications will be apparent to those skilled in the art and, therefore, the invention is defined in the claims.

What is claimed is:

1. A chair control mechanism with a latch comprising:

an arm mounted in a main bracket for axial sliding between a first position and a second position;

a latch bar extending transversely of said arm and biased against said arm increase the force necessary to axially slide said arm; and a seat plate pivotally mounted to said main bracket;

wherein said arm has a restraint adapted to engage said latch bar while said arm is in said first portion, such that said axial sliding of said arm into said second position is possible only after providing a force necessary to disengage said latch bar from said restraint; and wherein said first position is a locked position wherein said seat plate is restricted in movement relative to said main bracket and said second position is an unlocked position where said seat plate movement relative to said main bracket is allowed.

2. The chair control mechanism of claim 1 wherein said arm may be rotated while said latch bar is engaged in said restraint.

3. The chair control mechanism of claim 1 wherein said latch bar is a resilient metal wire.

4. The chair control mechanism of claim 3 wherein one end of said resilient metal wire hooks onto and bears against said main bracket and the opposite end of said resilient metal wire bears against the bottom of said seat plate.

5. The chair control mechanism of claim 4 wherein said restraint comprises a notch in said arm.

6. A chair control mechanism with a latch comprising:

an arm mounted in a main bracket for axial sliding between a first position and a second position; and a resilient metal wire biased against said arm to increase the force necessary to axially slide said arm;

wherein said arm has a restraint adapted to engage said resilient metal wire while said arm is in said first position, such that said axial sliding of said arm into said second position is possible only after providing a force necessary to disengage said resilient metal wire from said restraint.

7. The chair control mechanism of claim 6, wherein said restraint comprises a notch in said arm.

* * * * *